US006550362B1

(12) United States Patent
Galinat et al.

(10) Patent No.: US 6,550,362 B1
(45) Date of Patent: Apr. 22, 2003

(54) APPARATUS AND METHOD FOR DISPENSING FIBERS INTO CEMENTITIOUS MATERIALS

(75) Inventors: Melvyn A. Galinat, Mableton, GA (US); James M. Gilbert, Rome, GA (US)

(73) Assignee: SI Corporation, Chickamauga, GA (US)

( * ) Notice: Subject to any disclaimer, the term of this patent is extended or adjusted under 35 U.S.C. 154(b) by 212 days.

(21) Appl. No.: 09/696,317

(22) Filed: Oct. 25, 2000

(51) Int. Cl.[7] ..... B26D 7/06; B28C 7/04

(52) U.S. Cl. ..... 83/23; 83/370; 366/8; 366/151.1; 366/153.3

(58) Field of Search ..... 63/23, 361, 367, 63/370; 366/8, 17, 30, 151.1, 153.3; 414/300, 328, 413, 595, 675, 677; 422/232, 233, 238; 206/820; 221/1, 22, 30; 242/554.2, 911, 912

(56) References Cited

U.S. PATENT DOCUMENTS

| | | | | |
|---|---|---|---|---|
| 831,658 A | | 9/1906 | Ericsson | |
| 1,654,829 A | | 1/1928 | Pfeiffer | |
| 1,916,531 A | | 7/1933 | Robb | |
| 3,453,799 A | * | 7/1969 | Cloud et al. | 53/385.1 |
| 3,645,961 A | | 2/1972 | Goldfein | 260/37 |
| 4,400,126 A | | 8/1983 | Desourdy | 414/332 |
| 4,703,765 A | * | 11/1987 | Paules et al. | 83/355 |
| 4,712,919 A | | 12/1987 | Bouldin | 366/133 |
| 5,224,774 A | | 7/1993 | Valle et al. | 366/2 |
| 5,567,106 A | | 10/1996 | Gassner | 414/412 |
| 5,931,610 A | * | 8/1999 | Rixom et al. | 366/196 |
| 6,004,888 A | * | 12/1999 | Sugimoto et al. | 139/1 R |
| 6,047,528 A | * | 4/2000 | Scholin et al. | 53/373.9 |
| 6,283,327 B1 | * | 9/2001 | Rubtsov | 222/168 |
| 6,348,093 B1 | * | 2/2002 | Rieder et al. | 106/724 |

FOREIGN PATENT DOCUMENTS

| | | |
|---|---|---|
| EP | 0 499 572 A1 | 8/1992 |
| WO | WO 95/09723 | 4/1995 |

* cited by examiner

*Primary Examiner*—Allan N. Shoap
*Assistant Examiner*—Stephen Choi
(74) *Attorney, Agent, or Firm*—Renner, Kenner, Greive, Bobak, Taylor & Weber

(57) ABSTRACT

An apparatus (25) for transporting pre-measured quantities of fibers in a plurality of containers (13), separated by a plurality of webs (14), joining the containers together at spaced intervals, to a mixer (22) for cementitious materials, the apparatus comprising a conveying assembly (26), the containers therethrough; a counter assembly (28); a web slitting assembly (29); and a process controller (30), which activates the web slitting assembly in response to input from the counter assembly, in order to sever a determined number of the containers from the webs for conveyance into the mixer. A method for conveying pre-measured quantities of fibers suitable for the reinforcement of cementitious materials to a mixing apparatus is also provided as well as a train for providing pre-measured quantities of fiber comprising a plurality of containers containing the fibers; and a plurality of webs, joining the containers together at spaced intervals.

4 Claims, 3 Drawing Sheets

APPARATUS AND METHOD FOR DISPENSING FIBERS INTO CEMENTITIOUS MATERIALS

TECHNICAL FIELD

The present invention relates generally to the mixing of cementitious materials. More particularly, the present invention relates to dispensing reinforcing fibers into cementitious mixtures. Even more particularly, the present invention relates to an apparatus for more accurately and efficiently dispensing fibers into a cementitious mixture. Still more particularly, the present invention relates to an apparatus that automatically dispenses fiber quantities measured to commercial tolerances at the job site. Most particularly, the present invention relates to dispensing pre-measured quantities of fibers provided in a segmented belt.

BACKGROUND ART

Adding reinforcing fibers to cementitious materials and other aggregate produces desirable properties in these materials. For example, the presence of fibers may improve the ductility, toughness, and impact resistance of cementitious materials. The use of discrete fibers in the reinforcement of concrete is set forth in U.S. Pat. No. 3,645,961. The patent discloses the use of nylon, polyvinyl chloride and simple polyolefins in lengths ranging between one-quarter and three inches (0.6 to 7.5 cm).

When adding fibers at the job site, it is difficult to dispense accurate amounts of fiber into the cementitious mixture. Known field dispensing devices are portable, however, as they use weight or volumetric control, they have poor tolerances. Moreover, after production, fibers tend to agglomerate further aggravating weight or volume measurements. To overcome this problem, fibers are weighed at the manufacturing plant to commercial tolerances, and then packaged in paper bags. After transporting the bags to the job site, these bags are then tossed directly into the-concrete mixer at the job site. One U.S. patent describing this method is U.S. Pat. No. 5,224,774 and provided an improvement over the use of plastic film bags which needed to be opened, then their contents were dumped into the mixer and finally the empty bags were collected, as waste.

Manually adding the fibers is time-consuming and laborious. Manpower used for adding the fibers could be dedicated to pouring and spreading the concrete. When large amounts of fiber are added, the tedium of manually adding the fiber bags may cause workers to loose count of the number of bags added to the mix resulting in an inaccurate mixture.

As can be appreciated, the quantity of fiber dispensed in the material is critical in at least two respects. First, the quantity of fiber affects the physical characteristics of the resultant material. Second, on a per weight basis, the fibers are the most expensive component in the mixture.

Therefore, a need exists for a fiber dispensing device that dispenses fibers within commercial tolerances.

There is a further need for a fiber dispensing device that can be readily used at the job site to deliver fibers directly into concrete, measured to commercial tolerances.

There is a further need for a fiber dispensing article that can be used to continuously supply fibers in pre-measured quantities.

There is a further need for a fiber dispensing apparatus that eliminates manual delivery of the fibers to the mixer and automatically measures the quantity of fiber being added. Heretofore, the art has not provided such an apparatus. U.S. Pat. No. 1,916,531 provides an apparatus for loading cement bags into a mixer, employing a conveyor belt with buckets into which the bags of cement are placed by the operator, following which the bags are counted and emptied into the mixer.

SUMMARY OF THE INVENTION

It is therefore an object of the present invention to provide a fiber dispensing apparatus that can be used to deliver quantities of fibers measured to commercial tolerances.

It is another object of the present invention to provide a fiber dispensing apparatus that can be used to automatically tally the amount of fiber added to the mixer.

It is another object of the present invention to provide a fiber dispensing apparatus that dispenses fibers within commercial tolerances.

It is another object of the present invention to provide a continuous segmented train of individual and separate containers that encapsulate discrete quantities of fibers, measured to commercial tolerances.

It is another object of the present invention to provide a train providing a plurality of containers carrying pre-measured quantities of fibers and a plurality of webs, joining the containers together at spaced intervals.

It is another object of the present invention to provide a fiber dispensing apparatus that controls the amount of fiber added to a mixer.

It is another object of the present invention to provide a fiber dispensing apparatus having a controller that stops the flow of fibers into a mixer when sufficient fibers have been added to the mixer.

It is another object of the present invention to provide a method for conveying sealed pre-measured quantities of fibers suitable for the reinforcement of cementitious materials to a mixing apparatus therefor.

In general, the present invention provides an apparatus for transporting pre-measured quantities of fibers in a plurality of containers, separated by a plurality of webs, joining the containers together at spaced intervals, to a mixer for cementitious materials, the apparatus comprising means for conveying, the containers therethrough; a counter assembly; a web slitting assembly; and a process controller, which activates the web slitting assembly in response to input from the counter assembly, in order to sever a determined number of the containers from the webs for conveyance into the mixer.

The present invention also provides a method for conveying premeasured quantities of fibers suitable for the reinforcement of cementitious materials to a mixing apparatus therefor comprising providing a plurality of containers, each carrying a pre-measured quantity of fibers separated by a plurality of webs, joining the containers together at spaced intervals; feeding the containers through a dispensing apparatus; counting a predetermined number of the containers within the apparatus; intermittently slitting containers from the webs in response to the step of counting; and feeding the containers into the mixing apparatus.

The present invention also provides in combination, a train carrying pre-measured quantities of fibers and a dispensing apparatus for transporting the pre-measured quantities of fibers to a mixer for cementitious materials, the train comprising a plurality of containers, each carrying a pre-measured quantity of fibers; and a plurality of webs, joining the containers together at spaced intervals; the apparatus comprising means for conveying the containers therethrough; a counter assembly; a web slitting assembly; and a process controller, which activates the web slitting assembly in response to input from the counter assembly, in order to sever a determined number of the containers from the train for conveyance into the mixer.

Finally, the present invention also provides a train for providing pre-measured quantities of fiber comprising a plurality of containers containing the fibers; and a plurality of webs, joining the containers together at spaced intervals.

BRIEF DESCRIPTION OF THE PREFERRED EMBODIMENT

Figure 1:
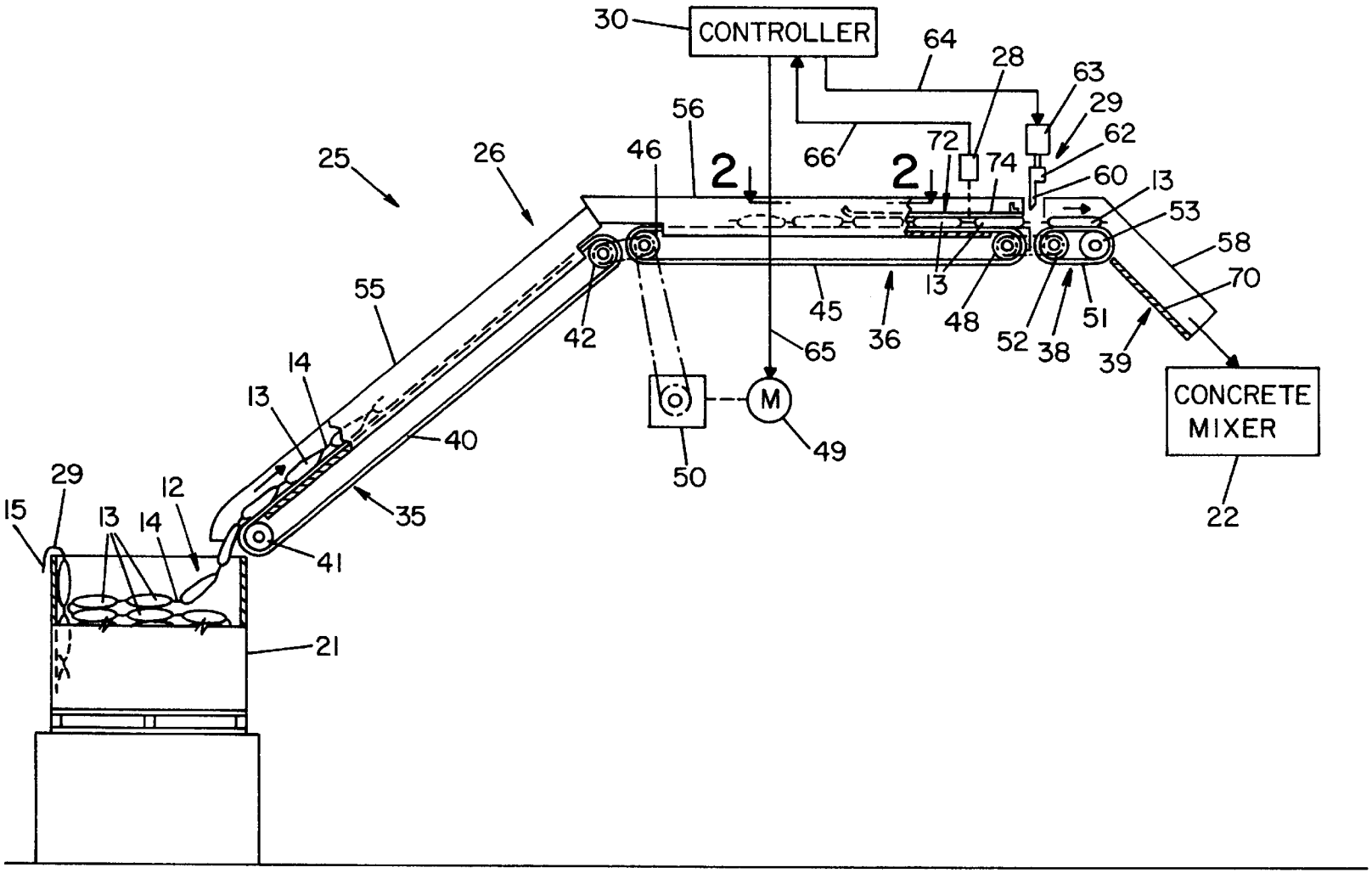
FIG. 1 is a partially schematic side elevation of a fiber dispensing apparatus according to the present invention.

The present invention relates to an apparatus for dispensing reinforcing fibers into conventional mixing apparatus for the preparation of cementitious materials. Cementitious materials, as used herein includes without limitation precast products, mortar, grout, shotcrete, cast in place concrete, stucco and the like, all of which generally comprise hardenable cement-like materials. The terms concrete or concrete mixtures shall be employed herein with the understanding that all types of concrete products and cementitious materials are included such as those listed herein above.

Reinforcement of concrete mixtures with fiber reinforcement is well known. The important functions of fiber reinforcement include: reduction of plastic shrinkage; increased abrasion resistance; gradual concrete permeability; increased concrete durability and toughness; improved post-crack performance; and improved impact and fatigue resistance by providing shock absorbency.

The fibers added to the concrete mixtures may be selected from the broad class of commercially available thermoplastic polymers and copolymers as well as fiber glass, carbon fibers, and steel fibers. Generally speaking, the fibers should neither affect the concrete nor be affected by the concrete and therefore, the fiber should not mold, rot, mildew, dissolve, or otherwise deteriorate in the concrete environment and should maintain its basic integrity throughout its useful life.

Useful fibers include polyolefins, such as polypropylene and polyethylene, polyesters, polyvinyl chloride, polyvinylidene chloride, polyamides, such as nylon-6 and nylon-66, and aromatic polyamides, such as KEVLAR®, polyacrylics, and the like, as well as, suitably coated fiberglass, carbon fibers, and steel fibers, but should not be limited to these. Generally, polyolefins formed with monomers having from about 2 to about 4 carbon atoms are employed because of their availability and cost although other polyolefins are not necessarily precluded. Practical considerations include energy absorption, tensile strength, and dispersability of the fiber in the concrete mixture. The absence of any one of these properties will not necessarily eliminate that particular polymer. Typically, thermoplastic fibers having specific gravity ranging from about 0.8 to 1.9 and fiberglass with a specific gravity range of about 2.5 to 2.7 are suitable. In addition, man-made cellulosic fibers such as rayon, acetate, or triacetate can be employed in 100 percent form, formed as mixtures or blends with the foregoing synthetic polymer fibers and strands, as can fiberglass fibers and strands, carbon, and steel fibers.

Configuration in shape of the fiber may be important, but neither is a controlling feature. The term fiber as employed herein shall be understood to include monofilament and multifilament materials as well as slit films and sheets of synthetic materials which may also be fibrillated. Filamentary materials are not limited to cylindrical or round configurations, but include all known cross-sectional configurations including but not limited to rectangular, square, round, oval, hollow, triangular, and the like. In addition, tri-lobal, multi-lobal, fibrillated, collated, bonded fibrils, entangled monofilaments or monofilaments and rolled boss film fibers are other practical types of concrete reinforcement. Hence, it is customary to refer to the denier of the material i.e., the weight in grams of a 9,000 meter length, rather than diameter. As is known, configuration of the filaments can also be straight, crimped, slugged, spiraled, gear crimped, saw-tooth configured, gnarled, cork-screwed, or otherwise deformed and all of these types are included.

The present invention further contemplates mixtures of fibers, as will be described in greater detail hereinbelow. It is to be understood that such mixtures encompass mixtures of one type of fiber in different sizes as well as mixtures of different fibers and mixtures of different fiber configurations. In each instance, the mixture may also include a range of different fiber sizes, that is, the mixture should be graded. For greater detail, one may refer to U.S. Pat. Nos. 5,456,752 and 5,628,822, owned by the Assignee of record, the subject matter of which is incorporated herein by reference. It is to be appreciated that selection of fibers is not limited to mixtures, as a single fiber type can be employed. In other words, practice of the present invention is not based upon the fibers, but rather, the conveyance of fibers of any type or form to mixing apparatus, for the reinforcement of cementitious materials.

Useful deniers range from about 0.5 to about 8,000 although broader ranges are not to be precluded. Preferred deniers range from about 340 to 2,600. Similarly the preferred lengths of fibers range between about 0.3 cm to about 5.1 cm although shorter and longer fibers, approximately 0.16 cm and about 7.6 cm respectively can be employed. Slit films and sheets will generally have thicknesses from about 0.025 mm to about 2.5 mm and widths from about 1.3 mm to 7.6 mm with 3.1 mm being preferred with lengths as noted herein-above. Selection of the fiber designs for a mixture is related to the application. Generally speaking, mixtures of the shorter fibers are preferred for stucco and the like, while longer fibers are preferred for concrete.

Irrespective of the form and type of fibers selected for addition to cementitious materials, use of the term "fibers" herein shall be understood to include any of the foregoing types, without being limited to those described. These fibers are further designated in the accompanying figures by the numeral 10.

Figure 2:
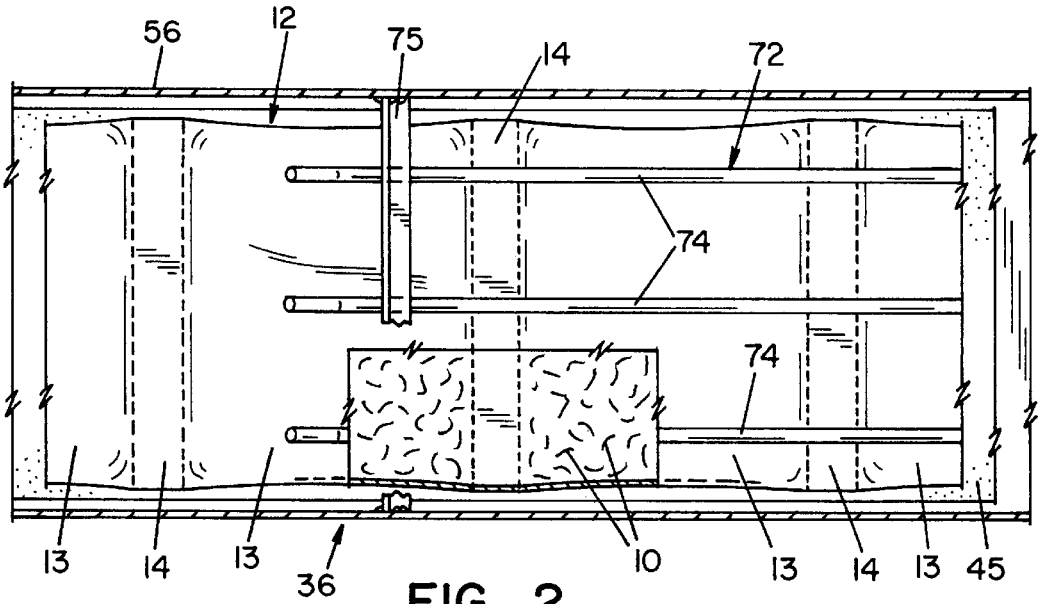
FIG. 2 is a fragmented partially cut away view, as taken along line 2—2 in FIG. 1.

At the fiber processing plant, the fibers 10, shown schematically in FIG. 2, are produced and measured to commercial tolerances, either by weight or volume. These measured quantities of fibers 10 are then packaged for shipment in a continuous string providing a plurality of separate containers, as will be described next. A unique feature of the present invention is the manner in which the fibers 10 are packaged for use in combination with the apparatus, referred to generally by the numeral 25 and hereinafter described. Such means for packaging fibers, also referred to as a train, is referenced generally by the numeral 12. Train 12 includes a plurality of individual containers 13, joined together by inter spaced webs 14, separating each of the containers 13 by a given distance and also providing a leading web (not shown) and a trailing web 15, each being connected to only a single container 13.

Typical container dimensions are approximately about 39 cm by 40 cm in order to contain 0.675 kg of reinforcing fiber, as one preferred amount. It should be understood that the container dimensions may be varied as dictated by packaging procedures, required bulk densities, and the like and thus, the foregoing dimensions are not limiting. Forming and sealing of container 13 may depend on the container structure or make-up and several suitable methods include heat sealing, gluing, bonding with adhesive or ultrasonic sealing, folding, perforation, sewing, thermoforming, or wrapping the contents. Water soluble adhesives, binders, cement or the like may be used.

Figure 5:
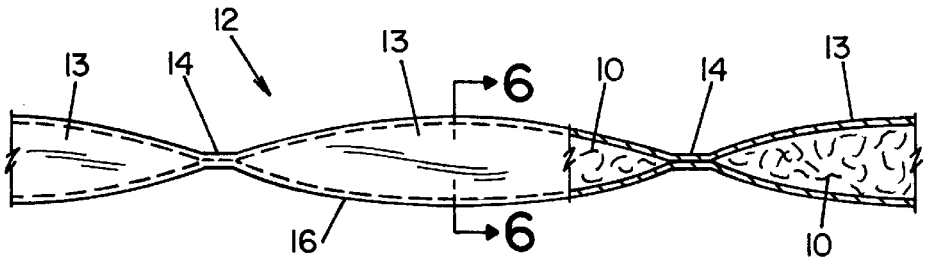
FIG. 5 is a cross-section of train, partially in section.
Figure 6:
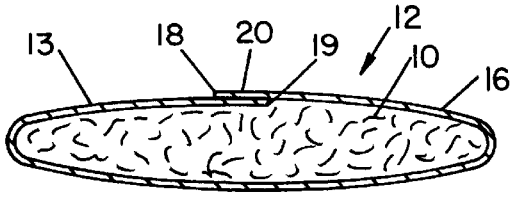
FIG. 6 is a cross-section of the train, taken substantially along line 6—6 of FIG. 5.

As best depicted in FIGS. 5 and 6 the train 12 includes a sheet 16 of packaging material that laterally wraps around fibers 10 with its edges 18, 19 joining at a single longitudinal seam 20. Each container 13 is separated by a transverse seam, web 14, which is preferably devoid of fibers. Both longitudinal and transverse seams 20, 14 may be formed using any of the sealing techniques described hereinabove.

Trailing web 15, FIG. 1, may be attached or formed at the end 29 of train 12. The trailing web 15 provides a point of attachment for additional trains 12. The trailing web 15 is left exposed such that additional trains 12 may be attached to the train 12 being processed. To facilitate attachment a leading web (not shown) identical to trailing web 15, but extending from the opposite end of train 12 may be used. Attachment may be accomplished through various known techniques including stapling or taping the trains 12 together. In this way, multiple trains 12 may be linked together without interrupting the mixing process.

As shown in FIG. 1, the train 12 may be loaded into a suitable container, such as a gaylord 21 not part of the present invention, and transported to the job site. From the container 21 the train 12 is carried to a conventional mixer 22, where the pre-measured quantities of fibers 10 are mixed into and with the cementitious materials. As will be described next, the dispensing apparatus of the present invention, referred to generally by the numeral 25, is employed to convey the train 12 to the mixer 22.

The apparatus generally includes train conveyor means, indicated generally by the numeral 26, a counter assembly, indicated by the numeral 28, a web slitting assembly, indicated by the numeral 29 and a process controller, indicated by the numeral 30. In the interest of simplification, various frame members upon which the various components are mounted, positioned and supported, have been deleted, it being understood that the particular construction of a frame for the apparatus 25 is not necessary to the understanding of the apparatus. Accordingly, the description shall proceed with reference to the components of the apparatus somewhat schematically.

Generally, the train conveyor means 26 includes an inlet means, generally 35, a primary driven conveyor, generally 36, an optional secondary driven conveyor, generally 38, and an outlet means, generally 39. Inlet means 35, is provided in order to elevate the fiber train 12 to a height greater than that of the opening in the concrete mixer 22. As depicted in FIG. 1, it can comprise a conveyor belt 40, mounted around rollers 41 and 42. Alternatively, inlet means is not limited to a conveyor belt, but can include ramps, a table of rollers, moving track elements, and drum-feed mechanisms or any other friction reducing surface that will allow the train 12 to be drawn from the gaylord 21.

The primary driven conveyor 36 Is mounted at an obtuse angle relative to said inlet means 35 and is generally horizontally oriented. It also includes a conveyor belt 45, mounted around rollers 46 and 48. A motor 49 is provided which may be connected to gear box 50 to drive at least one of the rollers 46, transmitting rotational force to the belt 45, which, in turn, draws the train 12 over the inlet means 35 and over the primary driven conveyor 36. It is to be appreciated that drive conveyed to the belt 45 can be transmitted from the motor in any conventional manner, including but not limited to belts, gears and the like and accordingly, for simplification, such means are not shown. If desired, a belt or other power conveying device can link the driven roller 46 to roller 42, thereby rotating the conveyor belt 40 of inlet means 35 and reducing the drag on train 12 from the gaylord 21 to the primary conveyor 36.

The secondary driven conveyor 38 includes a conveyor belt 51, mounted around rollers 52 and 53. It is mounted in generally the same horizontal plane as the primary conveyor 36. Again, a belt or other power conveying device is provided to link the driven roller 48 to roller 52, thereby rotating the conveyor belt 51 to convey a severed container 13 from the train 12, as will be explained hereinbelow. Suitable tracking mechanisms (not shown) can be employed to maintain the belts 45, 51 and 40 aligned upon the rollers, as is known in the art.

To protect the fibers 10 and train 12 from rain and such during transport through the train conveyor means 26, shrouds 55, 56 and 58 may be placed over the inlet means 35, primary conveyor 36 and optional secondary conveyor 38, respectively. To regulate the speed of the primary conveyor belt 45, motor 49 is controlled by the process controller 30. As can be appreciated, controller 30 may adjust the speed of fiber delivery or completely stop the movement of the train 12 as needed.

As also shown in FIG. 1, the primary driven conveyor 36 is horizontally oriented, and the belt 45 is positioned to receive the train 12 from inlet means 35 and guide the train 12 through the counter assembly 28 and web slitting assembly 29. The counter assembly 28 may be located up-stream of cutting assembly 29 near the outboard end of the primary driven conveyor 36. Counting assembly 28 preferably includes a sensor for detecting indicia located on the train 12. For a visual sensor, typical indicia may include contrasting markings, notches or perforations. The indicia may be carried on containers 13 or preferably on web 14. To perform counting, counter assembly 28 transmits a signal upon detection of the indicia to the controller 30, which logs the passage of containers 13. The same sensor and controller may be used to determine the location of a cut as will be described hereinbelow.

It is to be appreciated that any known counter assembly 28 may be used including visual counters that detect notches, perforations, tabs, color changes, bar-coding, or other indicia as described. Alternatively, the fiber dispensing apparatus 25 may incorporate a mechanical counter that detects the presence or absence of containers 13. It should also be understood that while process controller 30 uses the information from counter assembly 28, to count the number of containers 13 and to determine the location of a cut, process controller 30 may further determine the belt velocity from the counter assembly 28 by counting sensor activation during a given time period. Essentially, the sensor detects the presence of a fiber quantity 10 between webs 14. Based on this detection and the belt velocity, the process controller 30 can calculate the proper time to activate web slitting assembly 29. Activation of web slitting assembly 29 may be on a per container basis, as shown, releasing separate containers 13, or controller 30 may count the necessary number of containers 13 and then make a single cut that releases a strip of multiple containers 13. Similarly, controller 30 may time the cut to occur in the web 14 leaving the container 13 closed, or it may be used to open the container 13.

Once the appropriate number of containers 13 pass counter assembly 28, process controller 30 transmits a signal that activates the web slitting assembly 29. The process controller 30 may be programed to account for any delay between the moment the proper number of containers 13 passes counter assembly 28 and the moment that those containers 13 reach web slitting assembly 29. As can be appreciated, the web slitting assembly 29 may include any known cutter.

Figure 3:
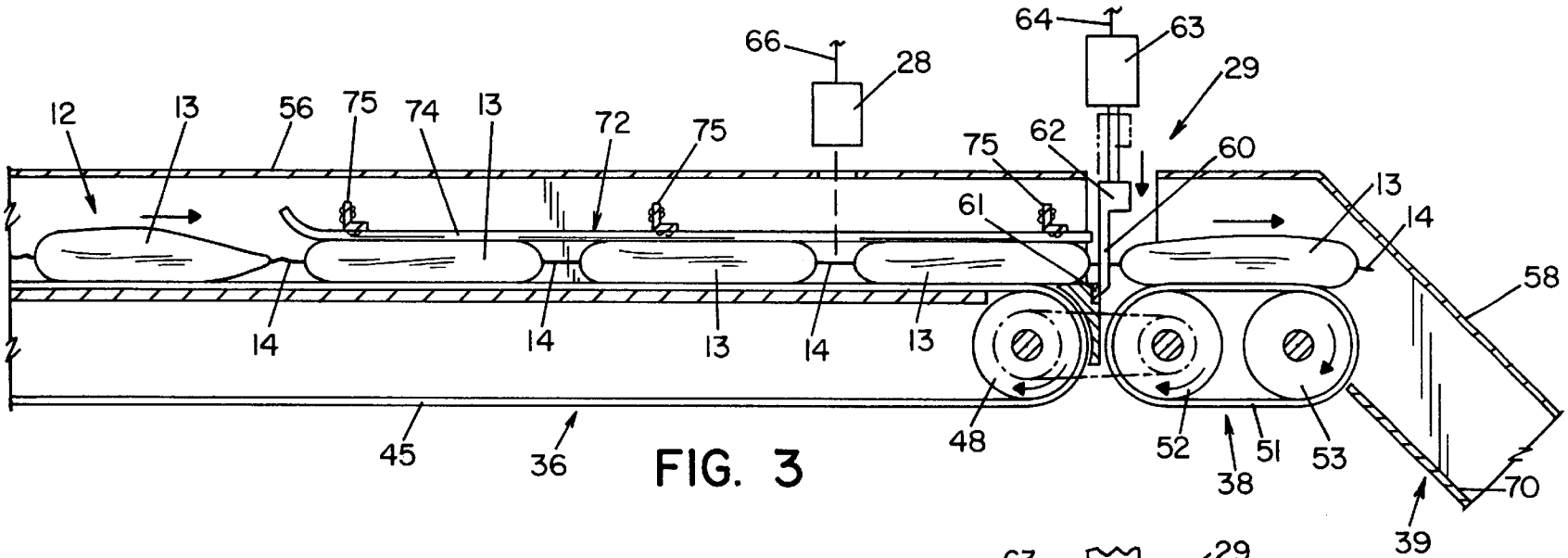
FIG. 3 is an enlarged side elevation of a portion of the apparatus, depicting a counter assembly and a web slitting assembly.

Next, the web slitting assembly 29 will be described. It employs blade 60 opposite a cutting surface 61, blade 60 being mounted in a movable holder 62 which is, in turn, driven by a fluid actuated cylinder 63. The entire assembly can be mounted in a frame (not shown) for reciprocal movement in a guillotine fashion to sever either the web 14, or, if so adjusted, to cut the container 13. As depicted in FIGS. 1 and 3, the train 12 is fed beneath the blade 60 and blade 60 is driven upon demand to the position shown in FIG. 3 to sever the train at that point.

With continued reference to FIG. 3, the counter assembly 28 and web slitting assembly 29 work in cooperation with the process controller 30 to sever the appropriate number of containers. As the containers 13 are carried along primary conveyor 26, the counter assembly 28 detects the presence of indicia as described above and sends a signal, reporting this detection, to the process controller 30. Depending on the method of control, the process controller 30 may, in turn, signal the activation of fluid cylinder 63 to cause blade 60 to sever the web 14 or container 13. Further, once the cut has been made, the process controller 30 may signal web slitting assembly 29 by a circuit 64 to retract movable blade holder 62. Also, if the speed of the conveyor 45 had been slowed or movement had been temporarily stopped, process controller 30 would provide a signal to the motor 49, via circuit 65, to resume operation. As the counting assembly 28 detects indicia on a container 13, or web 14, a signal is sent, via circuit 66, to the controller 30, directing the cylinder 63 to drive the holder 62 and blade 60, depicted in phantom, to sever a web 14.

Figure 4:
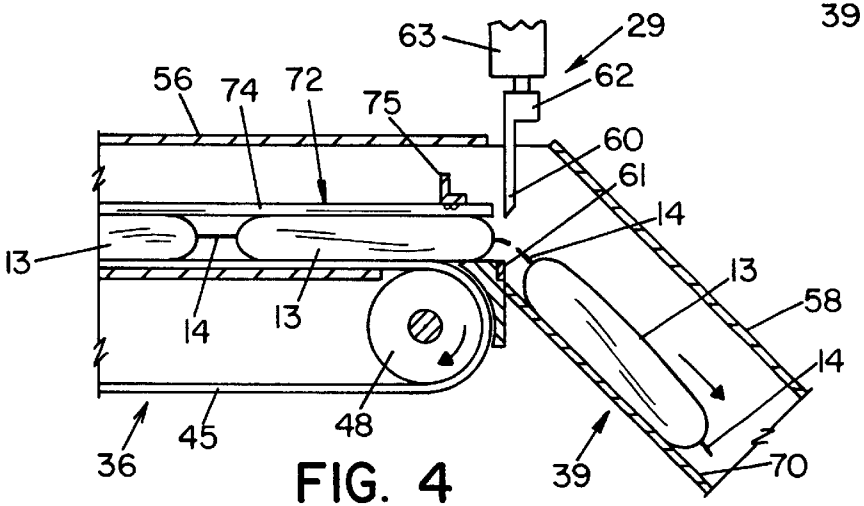
FIG. 4 is a side elevation of a portion of the apparatus, depicting an alternate embodiment.

With reference to FIG. 3, once a container has been severed from the train 12, it is then conveyed over the secondary driven conveyor 38 where it falls onto the outlet means 39, which is a chute or similar ramp 70 into the mouth of the concrete mixer 22. An alternative, simpler embodiment is presented in FIG. 4, in which the optional secondary driven conveyor 38 has been eliminated. In this variation, the container 13 is severed as before, however, it then drops via gravity directly onto the outlet means 39 and into the mouth of the concrete mixer. It is therefore to be appreciated that secondary conveyor is optional. It may be useful in some apparatus to be provided to ensure even passage of the severed container into the outlet means 39. Moreover, where the operation may require the short length of several containers severed from the train 12, instead of only one, the secondary conveyor will move the short segment smoothly into the outlet means 39.

Irrespective of the embodiment selected, outlet means 39 is also mounted an obtuse angle either to the primary conveyor or to both the primary and secondary conveyors so as to direct the severed containers 13 downwardly into the mixer 22. A further simplification (not shown) would be to allow the severed containers to drop vertically off of the primary or optional secondary conveyor, to fall directly into the mixer. We have found that more uniform operation is achieved, however, by employing outlet means 29.

While it should be appreciated that the counter assembly 28 may be placed at any location where it can count the containers 13, placing it adjacent to the web slitting apparatus 29, simplifies the timing of each cut that releases containers 13 into the mixer 22. Counter assembly 28 insures the proper fiber quantity enters mixer 22. For example, as shown in FIG. 3, the counter assembly 28 may be spaced from web slitting assembly 29 by the length of approximately one container 13. In this way, the detection of indicia located on web 14 would correspond to a previous web being located beneath web slitting assembly 29.

To further facilitate proper activation of web slitting assembly 29 a leveling assembly 72 may be used to insure that flexible containers 13 now presented in a substantially uniform configuration at the counter assembly 28 and web slitting assembly 29. For example, when bag-like containers 13 are used, some settling may occur during the transport of the container 13, changing the shape and consequently dimensions of the container 13. Such a situation is depicted somewhat schematically in FIG. 3. There, as the containers 13 approach the counter and slitting assemblies 28, 29, containers 13 pass under the leveling assembly 72, mounted up-stream of the counter and slitting assemblies 28, 29.

As best shown in FIGS. 2 and 3, assembly 72 may be constructed of a plurality of runners 74 suspended from brackets 75 mounted over the primary driven conveyor means 36, that serve to compact the container 13 such that any misshape in a container 13 is removed. In this way, the containers 13 may be presented to the counter assembly 28 and slitting assembly 29 with a substantially uniform longitudinal dimension. It will be appreciated, that other leveling mechanisms may be used such as a solid sled, rollers and conveyors, among others.

Since pre-measured fiber quantities 10 are used, the amount of fiber 10 for a given cementitious mixture becomes a function of the number of containers 13 added to the cementitious material. In this way, the fiber dispensing apparatus 25 delivers quantities of fiber 10 measured to commercial tolerances.

Practice of the method of the present invention should now be fairly evident. First, a fiber train is employed to carry pre-measured quantities of fibers in paper or other similar containers, each individual container being separated from the next by a web. The train is fed through a train conveyor means where it passes relative to counter and web slitting assemblies. One or more individual containers are counted and severed from the train after being counted and each is fed into a concrete mixing apparatus.

Thus, it should be evident that the apparatus and method of the present invention are highly effective in feeding a continuous line of pre-measured and separately packaged fibers to a mixing apparatus. The invention is particularly suited for the delivery of synthetic fibers to cementitious materials, but is not necessarily limited to any specific fiber or type of cementitious material. The apparatus and method of the present invention can be used separately with other equipment, methods and the like, not shown or necessary for practice of the present invention but which may be required for a given application.

Based upon the foregoing disclosure, it should now be apparent that the use of the apparatus and method described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, apparatus according to the present invention is not necessarily limited to those having a first and second conveyor means. Moreover, as noted hereinabove, other means for counting a slitting can be substituted for the respective assemblies described herein. Thus, the scope of the invention shall include all modifications and variations that may fall within the scope of the attached claims.

It should be understood that various modifications and alterations may be made to the above described apparatus, train for packaging the fibers and the method of operation without escaping the spirit of the present invention. For an appreciation of the scope of the invention, reference should be made to the following claims.

We claim:

1. A method for conveying pre-measured quantities of fibers suitable for the reinforcement of cementitious materials to a mixing apparatus therefor comprising:

providing a plurality of containers, each carrying a pre-measured quantity of fibers, separated by a plurality of webs joining said containers together at spaced intervals;

feeding said containers through a dispensing apparatus comprising, means for conveying said containers;

a counter assembly;

a web slitting assembly; and a process controller, which activates said web slitting assembly in response to input from said counter assembly, in order to sever a determined number of said containers from said web for conveyance into the mixer;

counting a predetermined number of said containers within said apparatus;

intermittently slitting containers from said webs in response to said counting; and feeding said containers into the mixing apparatus.

2. A method, as set forth in claim 1, wherein said train conveying means includes inlet means, a primary driven conveyor and outlet means.

3. A method, as set forth in claim 2, wherein said step of feeding includes the sequential steps of transporting said containers upwardly to a pre-determined elevation;

transporting said containers horizontally; and directing severed containers into the mixing apparatus.

4. A method, as set forth in claim 1, further including the step of leveling the fibers within said containers as they pass through said dispensing apparatus.

* * * * *